US008414718B2

(12) United States Patent
Sheridan

(10) Patent No.: US 8,414,718 B2
(45) Date of Patent: Apr. 9, 2013

(54) ENERGETIC MATERIAL COMPOSITION

(75) Inventor: Edward W. Sheridan, Orlando, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 1510 days.

(21) Appl. No.: 10/923,865

(22) Filed: Aug. 24, 2004

(65) Prior Publication Data

US 2005/0189050 A1 Sep. 1, 2005

Related U.S. Application Data

(60) Provisional application No. 60/536,231, filed on Jan. 14, 2004.

(51) Int. Cl.
*D03D 23/00* (2006.01)
*D03D 43/00* (2006.01)

(52) U.S. Cl. ..... 149/37; 149/108.2; 149/108.4; 149/109.2; 149/109.4

(58) Field of Classification Search ..... 149/37, 149/108.2, 108.4, 109.2, 109.4
See application file for complete search history.

(56) References Cited

U.S. PATENT DOCUMENTS 1,367,846 A * 2/1921 Washburn ..... 71/36
1,399,953 A 12/1921 Fulton
2,200,742 A 5/1940 Hardy
2,200,743 A 5/1940 Hardy
3,056,255 A * 10/1962 Thomsen ..... 60/219
3,254,996 A 6/1966 MacDonald
3,261,732 A 7/1966 Eilo
3,325,316 A 6/1967 MacDonald
3,344,210 A 9/1967 Silvia
3,362,859 A 1/1968 Sutton
3,377,955 A 4/1968 Hodgson
3,422,880 A 1/1969 Brown et al.
3,433,196 A * 3/1969 Sjoblom ..... 114/67 R
3,437,534 A 4/1969 McEwan et al.
3,596,602 A 8/1971 Gey et al.
3,632,458 A * 1/1972 Filter et al. ..... 149/19.3
3,661,083 A 5/1972 Weimholt
3,831,520 A 8/1974 Bowen et al.
3,961,576 A 6/1976 Montgomery, Jr.

(Continued)

FOREIGN PATENT DOCUMENTS

EP 1 348 683 A 10/2003
EP 1 659 359 A1 5/2006

(Continued)

OTHER PUBLICATIONS

James Eric McDonough, "Thermodynamic and Kinetic Studies of Ligand Binding, Oxidative Addition, and Group/Atom Transfer in Group VI Metal Complexes"; Dec. 2005, pp. 108-149.*

(Continued)

*Primary Examiner* — James McDonough
(74) *Attorney, Agent, or Firm* — Withrow & Terranova, PLLC

(57) ABSTRACT

An energetic material composition includes a reducing material and an oxide of phosphorus. The reducing material includes a reducing metal and, in an optional hydride form, auto disperses products of the reaction by the formation of a gaseous product. The composition can be included in a cavity of a warhead. A method of neutralizing a targeted species and a method of reducing structural integrity of civil engineering structures by reacting the composition are also provided.

18 Claims, 3 Drawing Sheets

U.S. PATENT DOCUMENTS

| | | | | |
|---|---|---|---|---|
| 4,112,847 | A | 9/1978 | Thomanek | |
| 4,129,465 | A | 12/1978 | Johnson et al. | |
| 4,357,873 | A | 11/1982 | Jager | |
| 4,703,696 | A | 11/1987 | Böcker | |
| 4,757,764 | A | 7/1988 | Thureson et al. | |
| 4,933,241 | A | 6/1990 | Holt et al. | |
| 4,982,667 | A | 1/1991 | Weimann | |
| 4,996,922 | A | 3/1991 | Halcomb et al. | |
| 5,000,093 | A | 3/1991 | Rozner et al. | |
| 5,090,322 | A | 2/1992 | Allford | |
| 5,243,916 | A | 9/1993 | Freche et al. | |
| 5,266,132 | A | 11/1993 | Danen et al. | |
| 5,392,713 | A | 2/1995 | Brown et al. | |
| 5,401,340 | A | 3/1995 | Doll et al. | |
| 5,429,691 | A | 7/1995 | Hinshaw et al. | |
| 5,439,537 | A | 8/1995 | Hinshaw et al. | |
| 5,505,799 | A | 4/1996 | Makowiecki | |
| 5,509,357 | A | 4/1996 | Lawther | |
| 5,538,795 | A | 7/1996 | Barbee, Jr. et al. | |
| 5,544,589 | A | 8/1996 | Held | |
| 5,547,715 | A | 8/1996 | Barbee et al. | |
| 5,567,908 | A | 10/1996 | McCubbin et al. | |
| 5,700,974 | A | 12/1997 | Taylor | |
| 5,717,159 | A | 2/1998 | Dixon et al. | |
| 5,732,634 | A | 3/1998 | Flickinger et al. | |
| 5,773,748 | A | 6/1998 | Makowiecki et al. | |
| 5,817,970 | A | 10/1998 | Feierlein | |
| 5,852,256 | A | 12/1998 | Hornig | |
| 5,859,383 | A | 1/1999 | Davison et al. | |
| 5,912,069 | A | 6/1999 | Yializis et al. | |
| 5,936,184 | A | 8/1999 | Majerus et al. | |
| 5,939,662 | A | 8/1999 | Bootes et al. | |
| 5,949,016 | A | 9/1999 | Baroody et al. | |
| 6,186,072 | B1 | 2/2001 | Hickerson, Jr. et al. | |
| 6,220,166 | B1 | 4/2001 | Cherry | |
| 6,276,276 | B1 | 8/2001 | Erickson | |
| 6,276,277 | B1 | 8/2001 | Schmacker | |
| 6,308,607 | B1 | 10/2001 | Woodall et al. | |
| 6,321,656 | B1 | 11/2001 | Johnson | |
| 6,382,105 | B1 | 5/2002 | Jones | |
| 6,443,789 | B2 | 9/2002 | Tominetti et al. | |
| 6,464,019 | B1 | 10/2002 | Werner et al. | |
| 6,467,416 | B1 | 10/2002 | Daniels et al. | |
| 6,494,140 | B1 | 12/2002 | Webster | |
| 6,520,258 | B1 | 2/2003 | Yang et al. | |
| 6,581,520 | B1 * | 6/2003 | Koch et al. | 102/336 |
| 6,597,850 | B2 | 7/2003 | Andrieu et al. | |
| 6,615,737 | B2 | 9/2003 | Bonnel et al. | |
| 6,627,013 | B2 | 9/2003 | Carter, Jr. et al. | |
| 6,666,143 | B1 | 12/2003 | Collins | |
| 6,668,726 | B2 | 12/2003 | Lussier | |
| 6,679,960 | B2 | 1/2004 | Jones | |
| 6,682,281 | B1 | 1/2004 | Larsen | |
| 6,682,817 | B1 | 1/2004 | Della Porta et al. | |
| 6,713,177 | B2 | 3/2004 | George et al. | |
| 6,720,204 | B2 | 4/2004 | Sudijono et al. | |
| 6,736,942 | B2 | 5/2004 | Weihs et al. | |
| 6,843,868 | B1 | 1/2005 | Fawls et al. | |
| 6,846,372 | B1 | 1/2005 | Guirguis | |
| 6,863,992 | B2 | 3/2005 | Weihs et al. | |
| 6,955,732 | B1 | 10/2005 | Chan et al. | |
| 6,962,634 | B2 | 11/2005 | Nielson et al. | |
| 6,991,860 | B2 | 1/2006 | Phillips et al. | |
| 7,191,709 | B2 | 3/2007 | Nechitalio | |
| 7,231,876 | B2 | 6/2007 | Kellner | |
| 7,278,354 | B1 | 10/2007 | Langan et al. | |
| 7,282,634 | B2 | 10/2007 | Kuklinski | |
| 7,383,775 | B1 | 6/2008 | Mock et al. | |
| 7,494,705 | B1 * | 2/2009 | Sheridan et al. | 428/336 |
| 7,513,198 | B2 | 4/2009 | Zhang et al. | |
| 7,658,150 | B2 | 2/2010 | Rönn et al. | |
| 7,718,016 | B2 | 5/2010 | Schild et al. | |
| 7,743,707 | B1 | 6/2010 | Melin et al. | |
| 7,770,521 | B2 | 8/2010 | Williams et al. | |
| 7,829,157 | B2 | 11/2010 | Johnson et al. | |
| 7,845,282 | B2 | 12/2010 | Sheridan et al. | |
| 7,886,666 | B2 | 2/2011 | Williams et al. | |
| 7,886,668 | B2 | 2/2011 | Hugus et al. | |
| 7,927,437 | B2 | 4/2011 | Gangopadhyay et al. | |
| 7,955,451 | B2 | 6/2011 | Hugus et al. | |
| 7,972,453 | B2 | 7/2011 | Sheridan et al. | |
| 8,033,223 | B2 | 10/2011 | Sheridan et al. | |
| 2001/0046597 | A1 | 11/2001 | Weihs et al. | |
| 2002/0069944 | A1 | 6/2002 | Weihs et al. | |
| 2003/0010246 | A1 | 1/2003 | Bonnel et al. | |
| 2003/0037692 | A1 | 2/2003 | Liu | |
| 2003/0097953 | A1 | 5/2003 | Serizawa et al. | |
| 2003/0131749 | A1 | 7/2003 | Lussier | |
| 2003/0164289 | A1 | 9/2003 | Weihs et al. | |
| 2003/0167956 | A1 | 9/2003 | Kellner | |
| 2003/0203105 | A1 | 10/2003 | Porta et al. | |
| 2004/0060625 | A1 | 4/2004 | Barbee et al. | |
| 2004/0101686 | A1 | 5/2004 | Porta et al. | |
| 2004/0151845 | A1 | 8/2004 | Nguyen et al. | |
| 2004/0244889 | A1 | 12/2004 | Sailor et al. | |
| 2005/0002856 | A1 | 1/2005 | Zaluska et al. | |
| 2005/0011395 | A1 | 1/2005 | Langan et al. | |
| 2005/0100756 | A1 | 5/2005 | Langan et al. | |
| 2005/0126783 | A1 | 6/2005 | Grattan et al. | |
| 2005/0142495 | A1 | 6/2005 | Van Heerden et al. | |
| 2005/0183618 | A1 | 8/2005 | Nechitailo | |
| 2005/0199323 | A1 | 9/2005 | Nielson et al. | |
| 2005/0235862 | A1 | 10/2005 | Gousman et al. | |
| 2007/0006766 | A1 | 1/2007 | Kellner | |
| 2007/0169862 | A1 | 7/2007 | Hugus et al. | |
| 2007/0272112 | A1 | 11/2007 | Nielson et al. | |
| 2007/0277914 | A1 | 12/2007 | Hugus et al. | |
| 2008/0035007 | A1 | 2/2008 | Nielson et al. | |
| 2008/0092764 | A1 | 4/2008 | Renaud-Bezot et al. | |
| 2008/0202373 | A1 | 8/2008 | Hugus et al. | |
| 2009/0078146 | A1 | 3/2009 | Tepera et al. | |
| 2009/0221135 | A1 | 9/2009 | Gangopadhyay et al. | |
| 2009/0235836 | A1 | 9/2009 | Pratt et al. | |
| 2009/0255433 | A1 | 10/2009 | Wang et al. | |
| 2010/0024676 | A1 | 2/2010 | Hugus | |
| 2010/0251694 | A1 * | 10/2010 | Hugus et al. | 60/253 |
| 2010/0269723 | A1 | 10/2010 | Hugus et al. | |

FOREIGN PATENT DOCUMENTS

| | | | |
|---|---|---|---|
| FR | 1 585 162 | A | 1/1970 |
| FR | 2 867 469 | A1 | 9/2005 |
| GB | 1 507 119 | A | 4/1978 |
| GB | 2 260 317 | A | 4/1993 |
| GB | 2 412 116 | A | 9/2005 |
| WO | WO 02/16128 | A1 | 2/2002 |

OTHER PUBLICATIONS

U.S. Appl. No. 13/526,170, Hugus et al.

Hugus, et al., Copending U.S. Appl. No. 13/526,170, filed Jun. 18, 2012 entitled "Structural Metallic Binders for Reactive Fragmentation Weapons".

Partial European Search Report issued in EP 07 10 9539, Oct. 23, 2007, 6 pages, European Patent Office, The Hague, NL.

Extended European Search Report issued in EP 07 10 9539, Jan. 16, 2008, 9 pages, European Patent Office, The Hague, NL.

Fischer, S.H., et al., "A survey of combustible metals, thermites, and intermetallics for pyrotechnic applications," AIAA Meeting Papers on Disc, Jul. 1996, pp. 1-13, American Institute of Aeronautics and Astronautics, Inc. , USA.

Shi, L.Q., et al., "Investigation of the hydrogenation properties of Zr films under unclean plasma conditions," J. Vac. Sci. Technol. A 20(6), Nov./Dec. 2002, pp. 1840-1845, American Vacuum Society, USA.

Seman, Michael et al., "Investigation of the role of plasma conditions on the deposition rate and electrochromic performance of tungsten oxide thin films", J. Vac. Sci. Technol., A21(6), Nov./Dec. 2003, pp. 1927-1933, American Vacuum Society, USA.

Grant, J., editor, Hackh's Chemical Dictionary, Third Edition, 1944, 4 pp. (cover page, title page and excerpt pp. 845-846), McGraw-Hill Book Company, Inc., New York, USA.

Lewis, Sr., R.J., editor, Hawley's Condensed Chemical Dictionary, 12th edition, 1993, 3 pp. (cover page, title page and excerpt p. 1139), Van Nostrand Reinhold Co., New York, USA.

Bennett, H., editor, Concise Chemical Dictionary, Third Enlarged Edition, 1974, 3 pp. (cover page, title page and excerpt p. 1037), Chemical Publishing Company, Inc., New York, NY , USA.

Webster's Ninth New Collegiate Dictionary, 1990, 3 pp. (cover, title page and excerpt p. 1224), Merriam-Webster's Inc., Springfield, Massachusetts, USA.
Boyd, J.M., "Thin-Film Electric Initiator. III. Application of Explosives and Performance Tests", U.S. Army Material Command, Report No. -HDL_TR-1414, Jan. 1969, 27 pages, Harry Diamond Laboratories, Washington, DC 20438.
Prakash, Anand, et al., "Synthesis and Reactivity of a Super-Reactive Metastable Intermolecular Composite Formulation of Al/$KMnO_4$", Advanced Materials, Apr. 2005, pp. 900-903, vol. 17, No. 7, WILEY-VCH Verlag Gmbh & Co. KGaA, Weinheim, DE.

* cited by examiner

ENERGETIC MATERIAL COMPOSITION

RELATED APPLICATION DATA

This application claims the benefit of U.S. Provisional Patent Application No. 60/536,231, filed on Jan. 14, 2004, entitled "PHOSPHORUS OXIDE BASED ENERGETIC MATERIAL," the entire content of which is herein incorporated by reference.

FIELD OF THE DISCLOSURE

The present disclosure relates to energetic material compositions. More specifically, the present disclosure relates to an energetic material composition based on oxide of phosphorus and its use in munitions, for example to neutralize a target agent and/or to reduce structural integrity of a civil engineering structure.

BACKGROUND INFORMATION

In the discussion of the state of the art that follows, reference is made to certain structures and/or methods. However, the following references should not be construed as an admission that these structures and/or methods constitute prior art. Applicant expressly reserves the right to demonstrate that such structures and/or methods do not qualify as prior art against the present invention A typical warhead configuration includes a hard casing which carries a payload material. The hard casing often includes a substantially elongated cylindrical body with an ogive shaped nose section. Such warheads can be deployed by cruise or ballistic missiles or by release from an aircraft, but are not limited to such deployment. Examples of current conventional warheads include the BLU-109, BLU-113, BLU-116, the Mk-82, Mk-83 and Mk-84 warheads. In some configurations, these warheads are a hard target penetrating warhead, designed to penetrate a hardened structural defense and deliver a main explosive payload to the interior of the structure.

Dissemination of weapons of mass destruction based on chemical or biological agents has compounded the difficulty in targeting and successfully destroying targets, including hardened targets, which contain such chemical or biological agents.

Conventional prompt agent defeat (PAD) and thermobaric (TBX) weapons are filled with white phosphorus and high explosive. The high explosive disperses the white phosphorus when the high explosive detonates. Dispersed white phosphorus burns when exposed to air and releases heat. The heat generated by white phosphorus can be used in a PAD weapon as a neutralizing agent, such as for neutralizing a chemical weapon, and/or can be used in a TBX weapon to create a thermobaric effect, in which a differential pressure induces or enhances the explosive effect of the weapon. Further, oxides of phosphorus resulting from the dispersion event and the burning event can combine with water to form phosphoric acid to therebv generate a residual agent neutralizing effect.

Because white phosphorus is pyrophoric, white phosphorus requires extensive safeguards for safe handling and storage. Typically, to prevent auto-ignition or to provide stable storage, white phosphorus is excluded from air, which complicates handling and storage procedures.

Representative devices for delivery of active biological and/or chemical agents are disclosed in U.S. Pat. No. 3,831,520 to Bowen et al., U.S. Pat. No. 3,661,083 to Weimholt and U.S. Pat. No. 3,596,602 to Gey et al. Generally, these devices do not disclose delivery of neutralizing agents. An example of an energy dense explosive (EDE), wherein particles of a reducing metal and a metal oxide are dispersed throughout a conventional high explosive, is disclosed in U.S. Pat. No. 6,679,960 to Jones. An example of a heat generating material is disclosed in U.S. Pat. No. 5,505,799 to Makowiecki.

There is a need for a substitute material for white phosphorus that is more stable, yet provides at least some of the performance of conventional white phosphorus, particularly in a weapon application.

SUMMARY

An exemplary energetic material composition comprises a reducing material and an oxide of phosphorus.

An exemplary method of neutralizing a targeted species comprises reacting a composition including a reducing material and an oxide of phosphorus to generate heat and to produce elemental phosphorus, and at least one of exposing the targeted species to the generated heat and exposing the targeted species to phosphoric acid formed from a product of reacting the reducing material and the oxide of phosphorus.

An exemplary method of reducing a structural integrity of a civil engineering structure comprises reacting a composition including a reducing material and an oxide of phosphorus to create a differential pressure, and exposing the civil engineering structure to the differential pressure.

An exemplary munition comprises a warhead having a cavity, and a composition including a reducing material and an oxide of phosphorus, the composition arranged in the cavity.

BRIEF DESCRIPTION OF THE DRAWING FIGURES

The following detailed description of preferred embodiments can be read in connection with the accompanying drawings in which like numerals designate like elements and in which.

DETAILED DESCRIPTION

Figure 1:
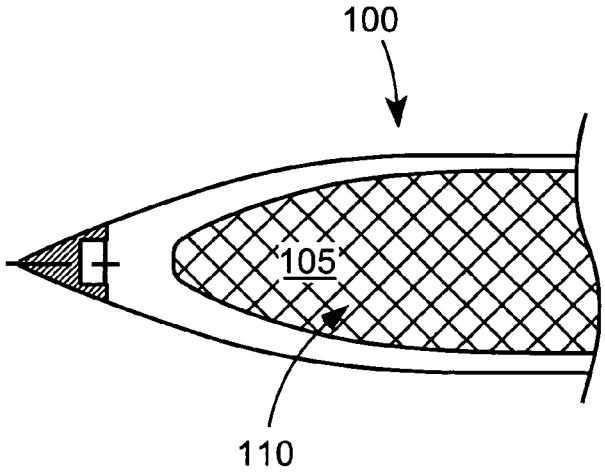
FIG. 1 shows a portion of an exemplary embodiment of a munition containing an energetic material composition.

FIG. 1 shows a portion of an exemplary embodiment of a munition 100 containing an energetic material composition 105. The energetic material composition comprises a reducing material and an oxide of phosphorus. The energetic material composition can be arranged, for example, within a cavity 110 of the munition 100.

The constituents of the energetic material composition can, upon initiation of a reaction, release energy and elemental phosphorus as a reaction product. The energetic material composition generally reacts as follows:

$$aM + bP_xO_y \xrightarrow{\delta} cM_nO_p + dP + \Delta heat$$

where M is a reducing material, $P_xO_y$ is an oxide of phosphorus, $M_nO_p$ is an oxide of the reducing material, P is elemental phosphorus, Δheat is a change in heat, and coefficients a, b, c, and d balance the reaction either stoichiometrically or non-stochiometrically. This reaction is autocatalytic once initiated by, for example, a fuse. Other suitable initiation mechanisms, δ, can also be used.

In one exemplary embodiment, the reducing material is a reducing metal. For example, the reducing metal can be selected from the group consisting of Li, Na, K, Be, Mg, Ca, B, Al, Ga, Ti, Zr, Zn, Cd, and alloys or mixtures thereof. In a preferred embodiment, the reducing material is aluminum. In another preferred embodiment, the reducing material is a hydride of the reducing metal.

In a further exemplary embodiment, the reducing material has a sufficiently high negative enthalpy in reaction with the oxide of phosphorus to produce a sufficient heat to neutralize a targeted agent. For example, a targeted agent can be a biological or chemical species and the heat derived in an exothermic reaction of reducing material and oxide of phosphorus is sufficient to neutralize the species. The capability of the material composition to produce a sufficient heat is preferred where the targeted agent is, for example, a biological or chemical agent capable of use in a weapon, such as a nerve agent or an infectious agent.

An example of a sufficiently high negative enthalpy, e.g., an exothermic enthalpy, in reaction with an oxide of phosphorus, e.g., $P_4O_{10}$, includes exothermic enthalpies in the range of approximately (e.g., ±10%) 400 cal per mole of oxide of phosphorous to 1300 cal per mole of oxide of phosphorous. Preferably, the oxide of phosphorous is $P_4O_{10}$ and the reducing material is aluminum or aluminum-based, e.g., an alloy or mixture of including aluminum.

Typically, sufficient heat in the context of neutralizing a targeted agent is greater than 100° C. Preferably, sufficient heat is greater than 300° C. and more preferably greater than 500° C. The sufficient heat is at temperature for at least a sustained period of time, such as, for example, one to three seconds. The time-temperature relationship varies for specific targeted agents, but is generally an inverse relationship, e.g., a higher temperature can be sustained for a shorter time and a lower temperature can be sustained for a longer time to obtain comparable neutralizing effect. The time-temperature relationship can be readily determined for a particular targeted agent.

In one exemplary embodiment, the oxide of phosphorus includes a stoichiometric oxide of phosphorous. For example, the stoichiometric oxide of phosphorous can be phosphorus pentoxide, $P_4O_{10}$. However, examples of oxides of phosphorus that may be used in the energetic material composition can also include non-stoichiometric oxides of phosphorous. These non-stoichiometric oxides of phosphorous can be used with reducing materials of suitable exothermic reaction enthalpies as described and disclosed herein.

The energetic material composition may be in the munition in any suitable form. For example, the exemplary embodiment of FIG. 1 schematically illustrates the energetic material composition 105 as a substantially homogeneous mixture of the reducing material and the oxide of phosphorus. An example of a mixture is mixed powders of reducing material and the oxide of phosphorus. The powders of the individual constituents of the energetic material composition can be any suitable size to produce a desired kinetic rate of reaction and, by extension, to produce a desired effect of the reaction. For example, the mixed powders can have an average diameter of at most 500 microns, preferably 10 to 100 microns, more preferably less than or equal to 10 microns, and most preferably 0.1 to 10 microns. Furthermore, the mixed powders of exemplary embodiments of the energetic material composition can be the same or different sizes (e.g., diameters) and can be ordered with different sizes to affect reaction kinetics, as disclosed in U.S. Pat. No. 6,679,960, the entire contents of which are incorporated herein by reference.

In one exemplary embodiment, powders of individual constituents of the energetic composition were milled mechanically, e.g. in a ball mill, or manually, e.g. with mortar and pestle, to an average diameter of less than 10 microns. The powders of the individual constituents were then jointly milled, mechanically or manually, to produce the final mixture. This final mixture was then available for reaction, for example, in a reaction initiated by a fuse, such as a nichrome bridgewire initiator.

Figure 2:
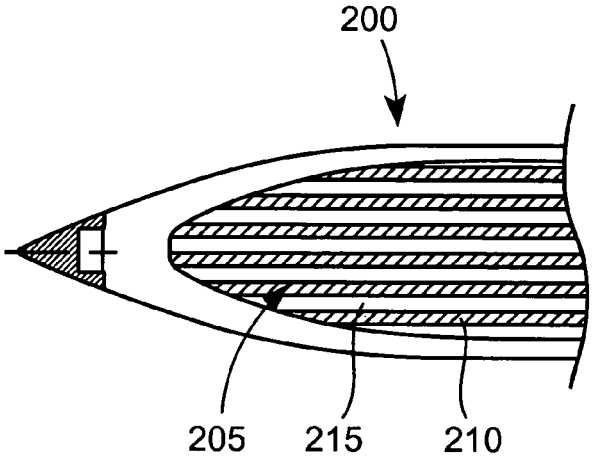
FIG. 2 shows a portion of an exemplary embodiment of a munition containing multiple portions of an energetic material composition.

Other forms of the energetic material composition may include substantially segregating the reducing material and the oxide of phosphorus. For example, FIG. 2 shows a portion of another exemplary embodiment of a munition 200 containing an energetic material composition 205 where the reducing material and the oxide of phosphorus are arranged in a layered structure having a first layer 210 of the reducing material and a second layer 215 of the oxide of phosphorus. The first layer and the second layer may be strictly alternated as shown where the first layer is adjacent the second layer, of may be of other multilayer arrangements having different periods of the first layer of the reducing material and the second layer of the oxide of phosphorus, or may be randomly distributed. Further, the first layer and the second layer may be separated from each other by a membrane or other separator.

Still further, the layers may have a transition zone between adjacent layers. For example, an adjacent first layer and second layer can have a gradient where the composition of the first layer decreases and the composition of the second layer increases as position within the layers changes from the first layer to the second layer. In other words, there is a compositional, transitional area between the species of the layers. In an additional example, a powder of a first species of the energetic composition may be poured into a cavity and optionally settled or leveled to form a first layer. A powder of a second species of the energetic composition may be poured into the cavity over a portion or over the whole of the first layer and optionally settled or leveled to form a second layer. This procedure may be repeated for as many species, e.g., two, three, four, or more, and as many layers, e.g., two, three, four, or more, as desired. The first layer and the second layer are not strictly separated, but rather are intermingled in the thickness of the transition zone where the powder of a second species was poured over the powder of the first species.

Thickness of each layer, whether a solid layer, powder layer or other form of layer, is generally such that a substantial amount, e.g., greater than 75%, preferably greater than 90%, of the constituents of the energetic composition participate in the reaction during any reaction. In other words, there is less than 25% unreacted material, preferably less than 10% unreacted material. The thickness of the layers is at least partially dependent on the length scales of the reaction kinetics. In one preferred example, the powder of each of the constituents is about (±10%) 500 microns in average diameter and the layer thickness of a layer of any one species is about (±10%) three times the average diameter, e.g. about 1500 microns for this example. Other sizes of powders and thicknesses of layers are contemplated, as disclosed herein.

Figure 3:
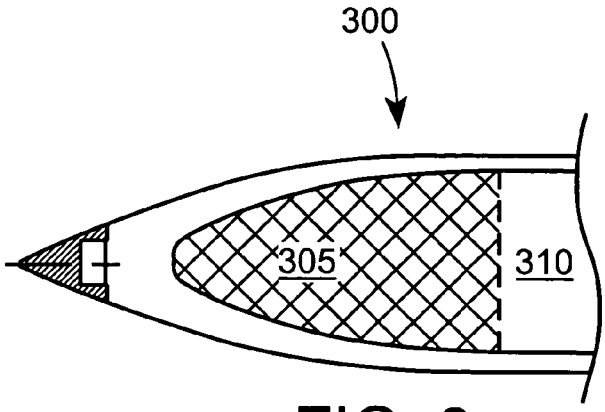
FIG. 3 shows a portion of a further exemplary embodiment of a munition containing an energetic material composition and a dispersing aid.

In exemplary embodiments, a dispersant aid is included to assist in dispersing the elemental phosphorus reaction product. For example, a high explosive can be included in the munition, which, upon detonation, disperses the elemental phosphorus. FIG. 3 shows a portion of a further exemplary embodiment of a munition 300 containing an energetic material composition 305 and a dispersing aid 310 in the form of a high explosive. An example of a suitable high explosive is Tritonal. The high explosive may be positioned at any suitable position within the cavity of the munition to provide a desired dispersion power or other dispersive effect, such as a shape of the detonation. Non-limiting examples of locations within the cavity for the high explosive include a nose end, an outer edge, a back edge, an annular position at an outer edge, at an interior region or at a central axis, or any other suitable location.

In preferred embodiments, the dispersing aid is integrated into the energetic material composition. For example, the dispersing aid can include a metal hydride, such as a metal hydride of a reducing metal disclosed herein. Initiation of the reaction of the energetic material composition, e.g., the reaction between the reducing metal hydride and the oxide of phosphorus, results in, in addition to the above disclosed heat and elemental phosphorus, an evolved gaseous product, such as hydrogen gas. The evolved gaseous product assists in dispersing the elemental phosphorus. In such preferred embodiments, a separate and dedicated dispersing aid, such as a high explosive, is preferably not utilized, although a high explosive based dispersing aid may optionally be included, for example, for additional dispersing power.

In general, exemplary embodiments of the energetic material composition can be used in a munition, such as in PAD or TBX weapons. For example, the heat generated by the elemental phosphorus can be used as a neutralizing agent, such as for a chemical species or a biological species, and/or can be used to create a thermobaric effect, in which a differential pressure induces or enhances the explosive effect of the weapon. Further, elemental phosphorus resulting from the dispersion event and the burning event can combine with water to form phosphoric acid. The phosphoric acid can generate a residual agent neutralizing effect.

Figure 4:
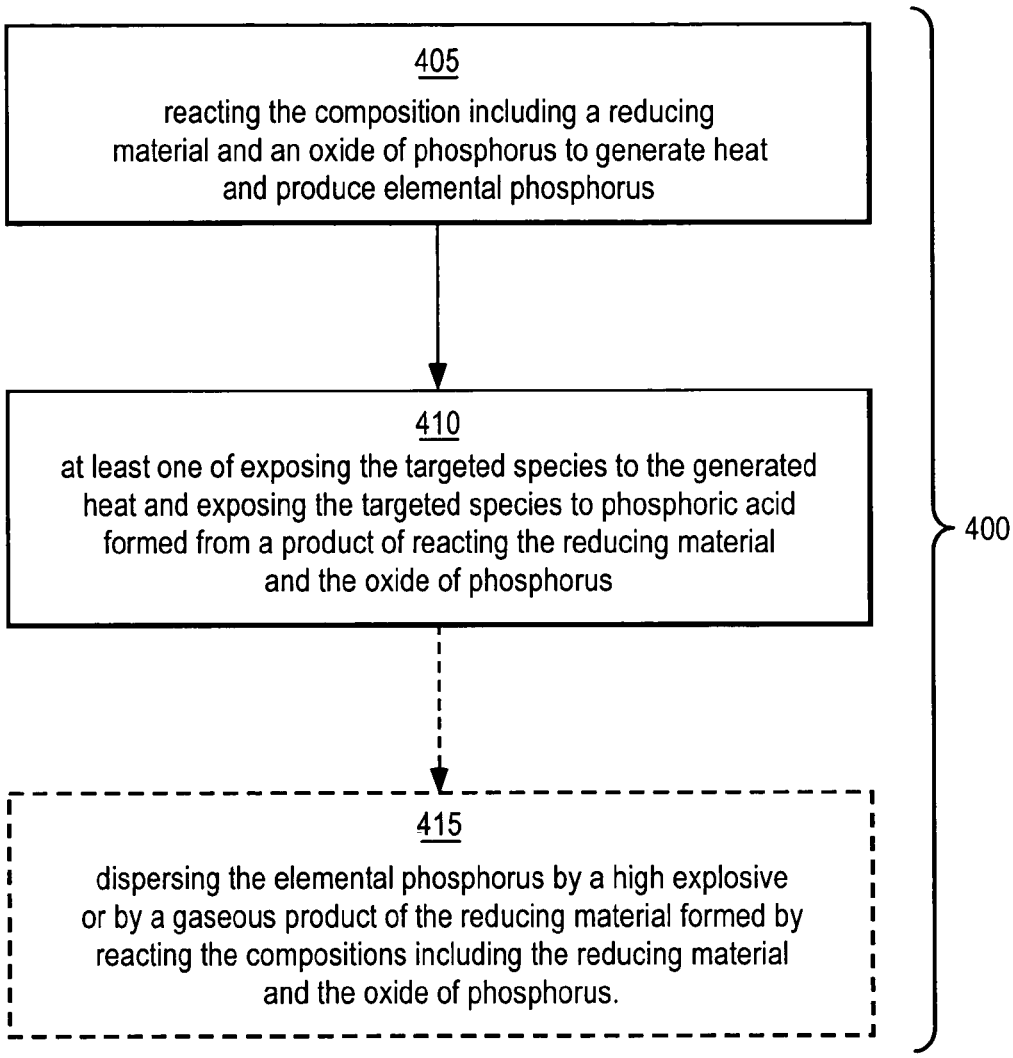
FIG. 4 illustrates an exemplary method of neutralizing a targeted species.

An exemplary method of neutralizing a targeted species is shown in FIG. 4. The FIG. 4 exemplary method 400 comprises 405 reacting the composition including a reducing material and an oxide of phosphorus to generate heat and to produce elemental phosphorus, and 410 at least one of exposing the targeted species to the generated heat and exposing the targeted species to phosphoric acid formed from a product of reacting the reducing material and the oxide of phosphorus, e.g., to neutralize the targeted species. Optionally, the method includes 415 dispersing the elemental phosphorus by a high explosive or by a gaseous product of the reducing material formed by reacting the composition including the reducing material and the oxide of phosphorus. In a preferred embodiment, the targeted species is a biological or chemical species and neutralizing the targeted species occurs before the targeted species can escape from repository site, such as a bunkered target.

In exemplary embodiments, overpressure can be generated through the production of hot gaseous reaction products. The overpressure can be used to damage structures, e.g., reducing structural integrity by collapsing walls, breaking windows, and/or breaking doors. Either the whole structure or a portion of the structure can be damaged.

Figure 5:
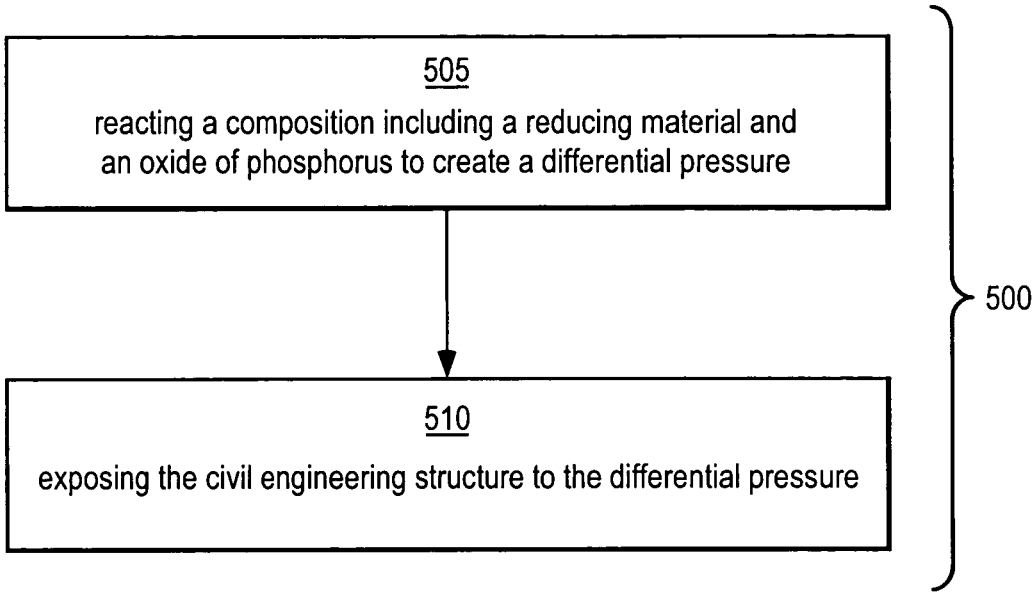
FIG. 5 illustrates an exemplary method of reducing a structural integrity of a civil engineering structure.

An exemplary method of reducing a structural integrity of a civil engineering structure is shown in FIG. 5. The FIG. 5 exemplary method 500 comprises, 505 reacting a composition including a reducing material and an oxide of phosphorus to create a differential pressure and 510 exposing the civil engineering structure to the differential pressure, e.g., to reduce the structural integrity. In a first option, the step of reacting generates heat and elemental phosphorus, which is dispersed by a high explosive. In another option, the step of reacting generates heat and elemental phosphorus, the elemental phosphorus dispersed by a gaseous product of the reducing material formed by reacting the reducing material and the oxide of phosphorus. In a preferred embodiment, the civil engineering structure is a building, such as a bunkered target, or any other structure such as a warehouse, a tunnel, and a buried repository.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. An energetic material composition comprising: a reducing material and an oxide of phosphorus, wherein the reducing material and the oxide of phosphorus react as follows:

$$aM + bP_xO_y \xrightarrow{\delta} cM_nO_p + dP + \Delta\text{heat}$$

where M is the reducing material, $P_xO_y$ is the oxide of phosphorus, $M_nO_p$ is an oxide of the reducing material, P is elemental phosphorus, Δheat is a change in heat, and coefficients a, b, c, and d balance the reaction either stoichiometrically or non-stoichiometrically; and a dispersing aid.

2. The energetic material composition of claim 1, wherein the reducing material is a reducing metal.

3. The energetic material composition of claim 2, wherein the reducing material is selected from the group consisting of Li, Be, Mg, Ca, Al, Ga, Ti, Zr, Zn, Cd, and alloys or mixtures thereof.

4. The energetic material composition of claim 2, wherein the reducing material is a hydride of the reducing metal.

5. The energetic material composition of claim 4, wherein the reducing material is selected from the group consisting of Li, Be, Mg, Ca, Al, Ga, Ti, Zr, Zn, Cd, and alloys or mixtures thereof.

6. The energetic material composition of claim 1, wherein the reducing material has a sufficiently high negative enthalpy in reaction with the oxide of phosphorus to produce a sufficient heat to neutralize a targeted agent.

7. The energetic material composition of claim 6 arranged within a warhead.

8. The energetic material composition of claim 7, wherein the targeted agent is a biological or chemical species.

9. The energetic material composition of claim 1, wherein the reducing material and the oxide of phosphorus are a mixture.

10. The energetic material composition of claim 1, wherein the reducing material and the oxide of phosphorus are a layered structure, wherein a first layer is the reducing material and a second adjacent layer is the oxide of phosphorus.

11. The energetic material composition of claim 1, wherein the reducing material and the oxide of phosphorous are each in powder form and the powders of the reducing material and the oxide of phosphorus are layered with a compositional transition area therebetween.

12. The energetic material composition of claim 7, arranged within a cavity of the warhead.

13. The energetic material composition of claim 1, wherein the dispersing aid is a gaseous product formed by a reaction of the composition.

14. The energetic material composition of claim 1, wherein the dispersing aid is a high explosive.

15. The energetic material composition of claim 14, wherein the high explosive is separated from the composition by a membrane.

16. The energetic material composition of claim 1, wherein the elemental phosphorus is a solid.

17. The energetic material composition of claim 1, wherein the elemental phosphorus exists as an allotrope.

18. The energetic material composition of claim 17, wherein the allotrope comprises white phosphorus ($P_4$).

* * * * *